US006807737B1

(12) United States Patent
Davia

(10) Patent No.: US 6,807,737 B1
(45) Date of Patent: Oct. 26, 2004

(54) ERGONOMIC OPENER FOR INTRAVENOUS BAG PACKAGING

(76) Inventor: Christina K. Davia, 4922 Briarleigh Chase, Mableton, GA (US) 30126

( * ) Notice: Subject to any disclaimer, the term of this patent is extended or adjusted under 35 U.S.C. 154(b) by 56 days.

(21) Appl. No.: 10/152,253

(22) Filed: May 21, 2002

(51) Int. Cl.[7] ..... B26B 3/00
(52) U.S. Cl. ..... 30/294; 30/2
(58) Field of Search ..... 30/2, 294, 123, 30/296.1, 278, 289, 280, DIG. 8

(56) References Cited

U.S. PATENT DOCUMENTS

| | | | | |
|---|---|---|---|---|
| 419,271 | A | 1/1890 | Low | |
| 1,377,805 | A | 5/1921 | Clear | |
| 3,803,713 | A | 4/1974 | Jones et al. | |
| D256,883 | S | 9/1980 | Wharmby | |
| 4,887,355 | A | 12/1989 | Colbert | |
| 5,007,171 | A | 4/1991 | Horning, Jr. | |
| 5,282,316 | A | 2/1994 | Anderson | |
| 5,419,044 | A * | 5/1995 | Valliere | 30/2 |
| 5,524,348 | A | 6/1996 | Tipp | |
| 5,720,062 | A | 2/1998 | Vaught | |
| 5,737,842 | A | 4/1998 | Freedman | |
| 6,003,181 | A | 12/1999 | Wenk | |
| 6,571,477 | B1 * | 6/2003 | Mothena et al. | 30/280 |
| 2002/0038512 | A1 * | 4/2002 | Voltolato | 30/294 |

FOREIGN PATENT DOCUMENTS

GB 2 234 699 A * 2/1991

* cited by examiner

*Primary Examiner*—Hwei-Siu Payer

(57) ABSTRACT

A device for cutting and opening the packaging around intravenous fluid bags, and assisting in the removal of the capped end of the bag. The base 10 and body 16 are made out of a highly durable material to withstand constant use. The base 10 is secured to a stable surface by fasteners 12. The razor 14 is inserted into the body 26 through a slot 16, and is held in place by brackets 35. Cover 20 snaps onto the body 26, concealing the razor 14. The user lines the bag up with the guidelines 22, 22' and slides it in between the base 10 and body 26 across the razor 14. The hook 18 facilitates removal of the capped end of the bag, readying the bag for use.

4 Claims, 6 Drawing Sheets

ERGONOMIC OPENER FOR INTRAVENOUS BAG PACKAGING

FEDERALLY SPONSORED RESEARCH

Not Applicable

SEQUENCE LISTING OR PROGRAM

Not Applicable

BACKGROUND

1. Field of Invention

This invention relates to a cutting device and more specifically to a medical device for opening the outer packaging around intravenous fluid bags.

BACKGROUND

2. Discussion of Prior Art

Intravenous (IV) bags are packaged in a sealed outer layer of durable plastic to ensure no contamination or leaking of the fluid occurs. This outer layer must be removed prior to administering the IV fluid. Currently there is a perforation in the IV bag packaging that is supposed to allow medical personnel to open the bag by tearing the plastic material first along the small perforation, and then continuing the tear into the non-perforated plastic. In a setting such as an emergency room, medical personnel must quickly tear open hundreds of these bags per shift. There are a number of problems that exist with this current method.

The first problem is that very often the bags are incompletely perforated, making the opening of the bag impossible. This bag is often tossed back into the supply and waits for the next person who needs an IV bag to attempt to open it. This attempt and inability to open the bag wastes valuable time in a medical setting where time is crucial and can mean life or death.

The second problem that is caused by this inefficient method of opening IV bags is a repetitive motion injury to the thumb, hand or wrist. By producing the forceful motion needed to open the IV bag, in a highly repetitive manner, medical staff members (specifically nurses) have reported pain along the lateral border of the thumb, and in the radial aspect of the wrist consistent with tendonitis or DeQuervains Tenosynovitis/Syndrome. This injury frequently requires medical treatment, such as medication or physical therapy, and rest, making it responsible for days lost from work.

One alternative to tearing along the partially perforated packaging would be to use a scissor. This presents other problems. Using a scissor would eliminate the forceful tearing motion, but it would not provide a quick, accurate, or safe way to open the bags. Additionally, using scissors would put strain on the same areas already stressed by the tearing method of opening the bags. Speed is crucial due to the fast paced nature of medical settings such as an emergency room. Accuracy is necessary so that the actual IV bag is not punctured and then considered unusable which would waste time, money and possibly valuable medications. Additionally, it may be difficult to keep portable scissors in one location so that they are readily available when needed. Also, if the wrong type of scissors were used, for example scissors with pointed ends, it could cause injury to the user.

The "snack pack opener" in U.S. Pat. No. 4,887,355 resolves the problem of quickly opening plastic packaging using a razor, and it does provide a support bracket assembly to mount the device underneath a countertop, in one location. However, it does not provide a guide or a means for accurately opening the packaging, nor does it provide a means of attaching the device to the top of a counter top so that the packaging can be opened in an ergonomically correct way, nor a means for removing the capped end of an IV bag. In addition, the "snack pack opener" requires double-edged razors that have 'bore holes' in order to secure the razor, a more expensive alternative than using standard razor blades.

Thus, there is a need to provide a device that can open the packaging on IV bags in an ergonomically correct, quick, accurate, convenient, reliable, cost-effective and safe manner.

OBJECTS AND ADVANTAGES

Accordingly, several objects and advantages of my invention are:

(a) to provide an opener which efficiently opens plastic packaging around intravenous bags;

(b) to provide an opener that is ergonomically correct and does not contribute to repetitive motion or overuse injuries;

(c) to provide an opener that allows the packaging to be opened with accuracy, so as to protect the contents of the package or without puncturing the IV bag;

(d) to provide an opener that can be securely mounted on top of a counter, cart, table or other horizontal surface or vertical surface to ensure availability when needed;

(e) to provide an opener that does not allow the user to become cut or otherwise injured by the razor;

(f) to provide an opener that is cost-effective and is low maintenance-requiring only the occasional replacement of standard single-edged razor blades.

Further objects and advantages are to provide an opener that has a hook to facilitate removal of the cap on the bottom of the actual intravenous bag, is easy to use with all size intravenous fluid bag packages, is simple and inexpensive to manufacture, is durable enough to withstand repetitive use, and is maintenance-free (except for simply replacing the razor blade). Still further objects and advantages will become apparent from consideration of the ensuing description and drawings.

SUMMARY

In accordance with the present invention an opener for intravenous bag packaging comprises a durable body that houses a standard razor blade, that has a hook portion and guide as part of the body, and that has a mounting bracket base to secure the body to a surface.

DRAWINGS

Drawing Figures

In the drawings, closely related figures have the same number but different alphabetic suffixes.

REFERENCE NUMERALS IN DRAWINGS

Figure 1A:
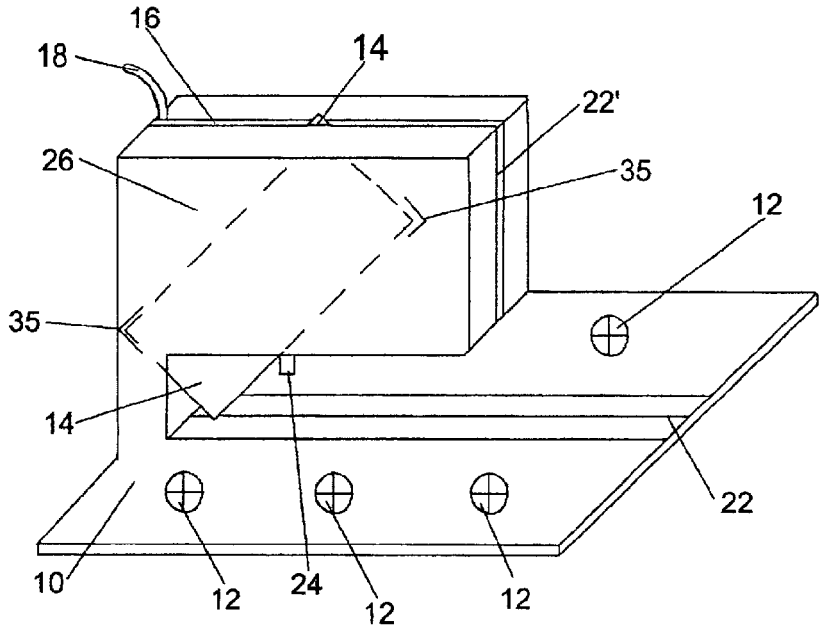
FIGS. 1A to 1F show various aspects of an intravenous bag opener with hook that can be mounted to a stable surface.

10 base of stationary opener
12 hole with screw or fastener of stationary opener
14 razor
16 slot for razor
18 hook
20 safety cover of stationary opener
22 guideline on base
22' guideline on body
24 safety guard
26 body of stationary opener
28 half of body of portable opener
30 half of base of portable opener
32 hole with screw or fastener of portable opener
34 junction of right and left halves of body
35 brackets
36 base of dynamic opener
38 fasteners of dynamic opener
40 body of dynamic opener
42 slot for razor of dynamic opener
44 dual purpose safety block and hook
46 ergonomic handle
48 razor holder of dynamic opener
50 protrusions

DETAILED DESCRIPTION

Figure 1B:
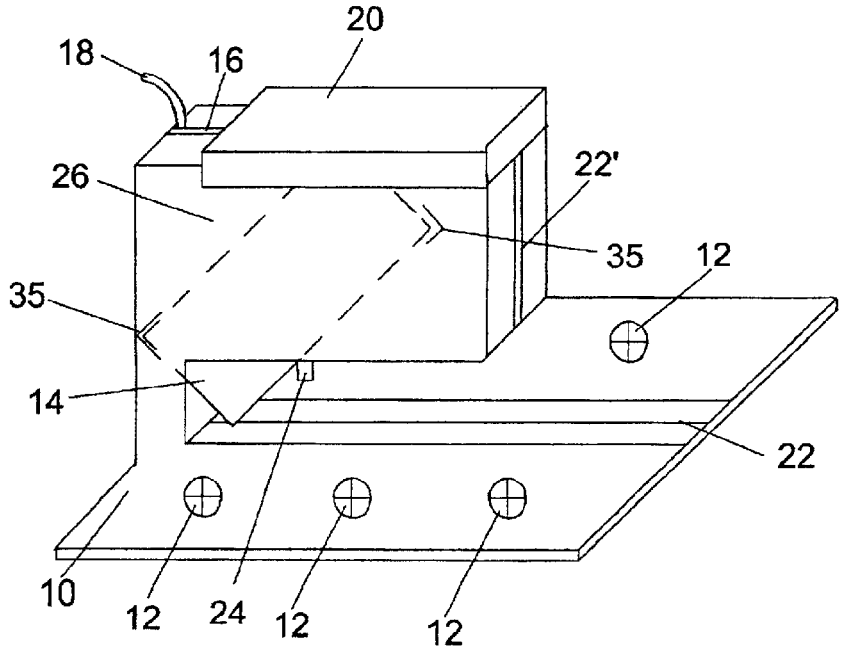
Figure 1C:
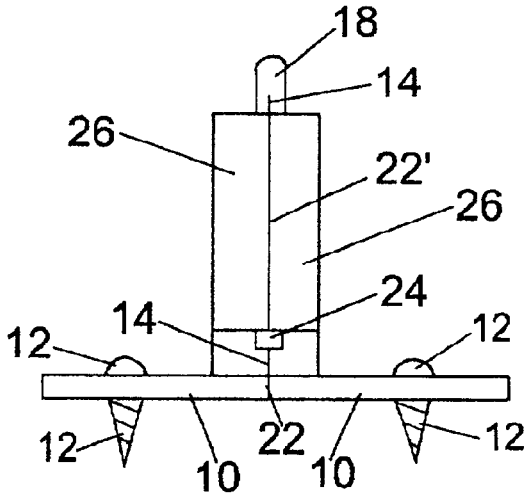
Figure 1D:
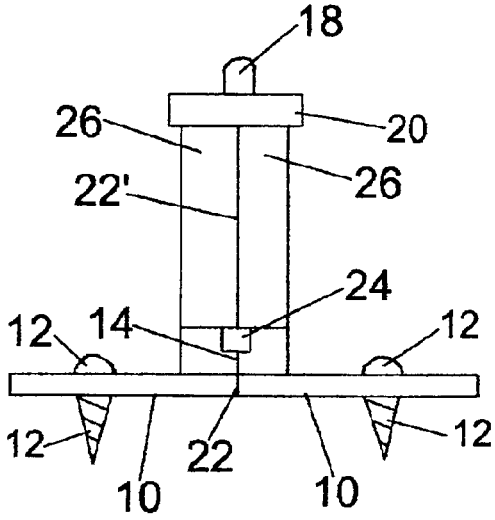
Figure 1E:
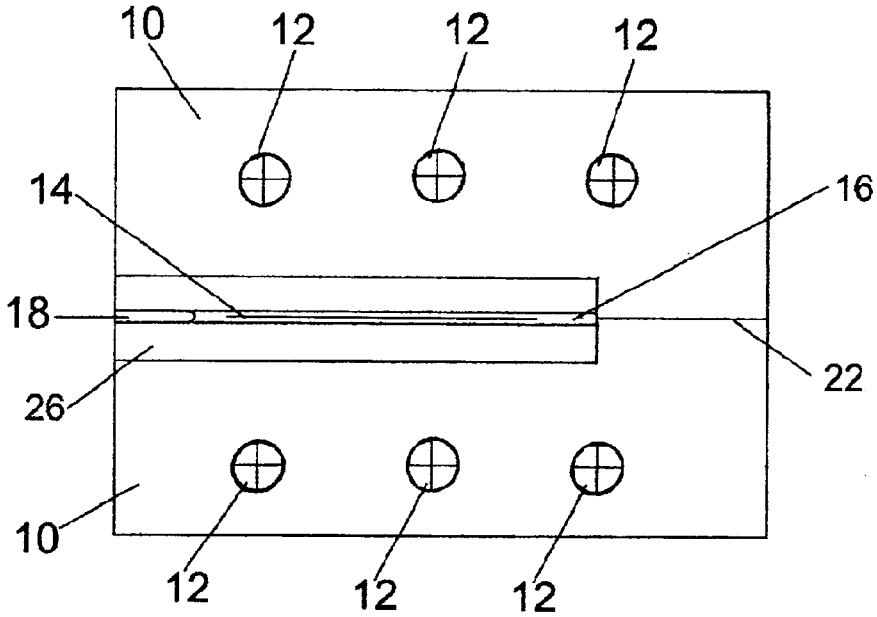
Figure 1F:
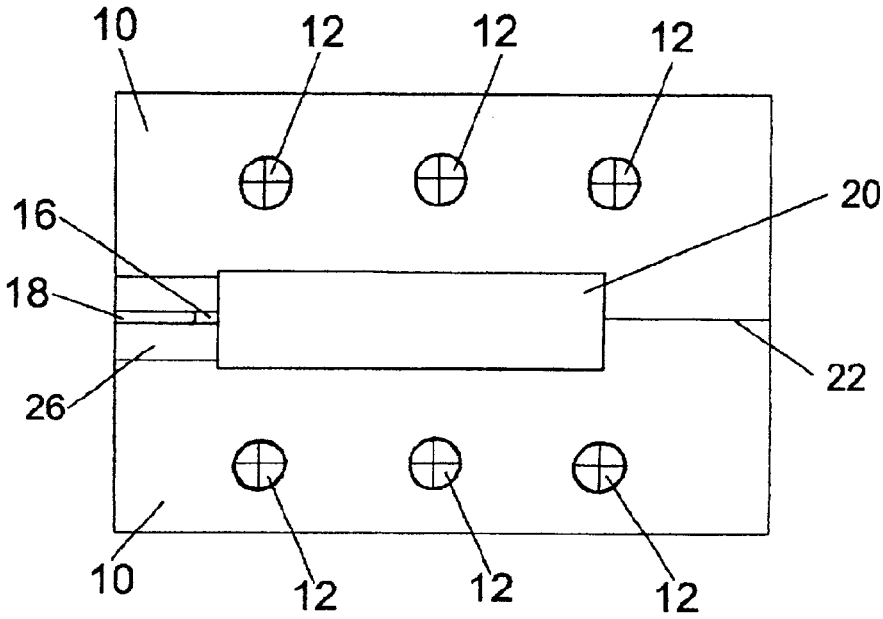

Description—FIGS. 1A, 1B, 1C, 1D, 1E and 1F—Preferred Embodiment A preferred embodiment of the basic intravenous bag opener of the present invention is illustrated in FIG. 1A (side view without cover on), FIG. 1B (side view with cover on), FIG. 1C (front view without cover on), FIG. 1D (front view with cover on), FIG. 1E (top view without cover on), and FIG. 1F (top view with cover on). The opener has a thin base 10 of uniform cross section consisting of a durable material such as metal, plastic, or rubber that can withstand constant use. There are holes with fasteners 12 in the base 10 that allow the intravenous bag opener to be fastened or mounted to a variety of surfaces. A guideline 22 is marked on or scored into the base 10 equidistant from edges of base 10.

A body of stationary opener 26 is on top of the base 10, and is made out of same material as base 10, with no obvious junctures between the two (body 26 and base 10). The body of stationary opener 26 has brackets 35 that hold a razor 14. The razor 14 is in line with a guideline on the body 22' and a guideline on the base 22. The razor 14 must be inserted through a slot 16 for razor 14 in order to hold the razor securely. In FIGS. 1B, 1D and 1F, a cover of stationary opener 20 snaps onto the top of the body of the stationary opener 26. This cover protects a piece of the dull edge of the razor 14 that is exposed. A safety guard 24 is also present in front of the razor 14 attached to the underside of the body 26. The safety guard 24 hangs in front of razor 14 leaving approximately less than 1 centimeter of razor 14 exposed, to allow enough space for the plastic wrapping to be guided across razor 14, but not enough space to allow for personal injury to user. A hook 18 is attached to, mounted on, or a part of the body 26.

Operation of Invention—FIGS. 1A–1D

The manner of using the intravenous bag opener to open the plastic wrapping around an intravenous bag (IV bag) is completely different from the current method where no device is utilized. The base of the opener 10 is to be mounted on a horizontal surface that is wide enough to accommodate the length of the largest size of IV bag. Screws or other fasteners (12) are used in order to mount the opener to the stable, horizontal surface. The IV bag can then be laid on or supported by the surface.

By holding the IV bag by the edges, the notch already in the sealed part of the IV bag can be lined up with the guidelines 22, 22' and guided past the razor 14 to be opened. The slot 16 must be narrow enough to hold the razor 14 securely. The slot 16 must be deep enough to allow the razor to protrude through the underneath side of the body 26 at an angle to allow it to cut through the outer wrapping of the IV bag, but shallow enough as well to allow for a small piece of the blunt side of the razor to be exposed superiorly to facilitate replacement of a dulled razor. Brackets 35 keep the razor in place.

The cover of the stationary opener 20 can be snapped onto the top of the body 26, in order to protect the user from being injured by the small piece of the blunt end of the razor that is raised in relation to the top of the body 26. The underneath side of the body has the safety guard 24 that allows for an opening of no more than one centimeter. The safety guard 24 allows the IV bag wrapping to slide past said safety guard, but prevents slightly larger item such as the users finger from coming in contact with the razor 14.

In order to remove the capped end from the IV bag itself, the hook 18 is provided. A looped pull tab that facilitates removal of the cap is present on IV bags. The looped pull tab can be placed on the hook 18. The bag is pulled away from hook 18 to remove the looped pull tab and attached cap from the end of the IV bag to expose the ends of the IV bag to which IV lines are attached.

Figure 2A:
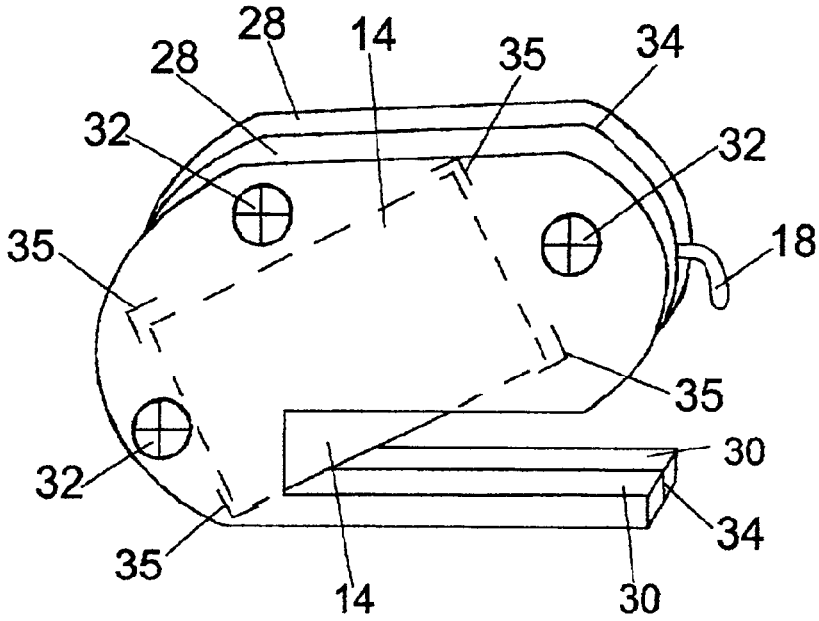
FIGS. 2A to 2B shows aspects of a portable intravenous bag opener.
Figure 2B:
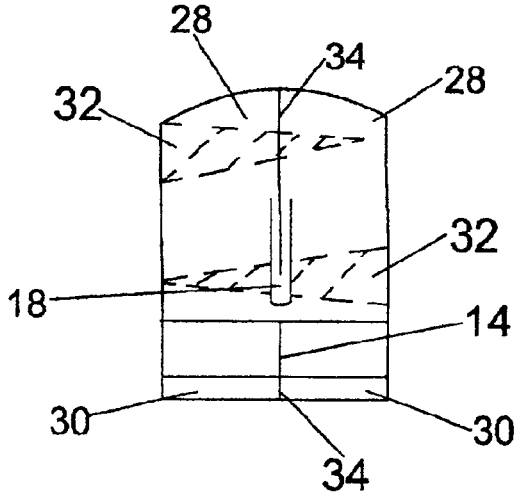

Description FIGS. 2A and 2B—Alternative Embodiment

FIGS. 2A and 2B show an alternative embodiment. FIG. 2A shows a side view of a portable or hand held intravenous bag opener and FIG. 2B shows a front view. Both FIGS. 2A and 2B show a much narrower base 30 than the preferred embodiment shown in FIGS. 1A–1E. The narrower base 30 of the portable opener lacks fasteners such as those in the preferred embodiment that fasten it to a stable surface. In FIGS. 2A and 2B, the opener is comprised generally of two halves. Each half is comprised of two general areas of the body 28 and the base 30, although there is no delineation between the two. One or more fasteners or screws 32 bind together the two halves of the portable body 28 and base 30 at a junction 34 of the right and left halves. The razor 14 is held entirely inside the body, between the two halves by four brackets 35. A hook 18 is on or a part of the body 28.

Operation FIGS. 2A and 2B—Alternative Embodiment

The manner in which to use the portable opener (FIGS. 2A and 2B) is much the same as the stationary opener (FIGS. 1A–1E). Differences exist in that instead of having an opener in just one place, the portable opener is not fixed to a surface, and can be carried from place to place. The user of the portable opener would simply lay the sealed intravenous bag down of a flat stable surface and place the base 30 on the surface so that the sealed plastic portion of the intravenous bag packaging could be brought in between the base 30 and body 28 to contact the razor 14. By moving the razor across the sealed plastic part of the outer wrapping, the bag is opened. In order to remove the cap with pull tab from the IV bag, simply loop the pull tab around the hook 18 and pull the opener away from the cap.

In order to replace the razor 14, remove the screws or fasteners 32 and separate the two halves of the body 28 and base 30 at their junction 34. Remove used razor and replace by putting a new razor securely in between the four brackets 35. Place both halves back together and tighten fasteners 32 to resume use.

Figure 3A:
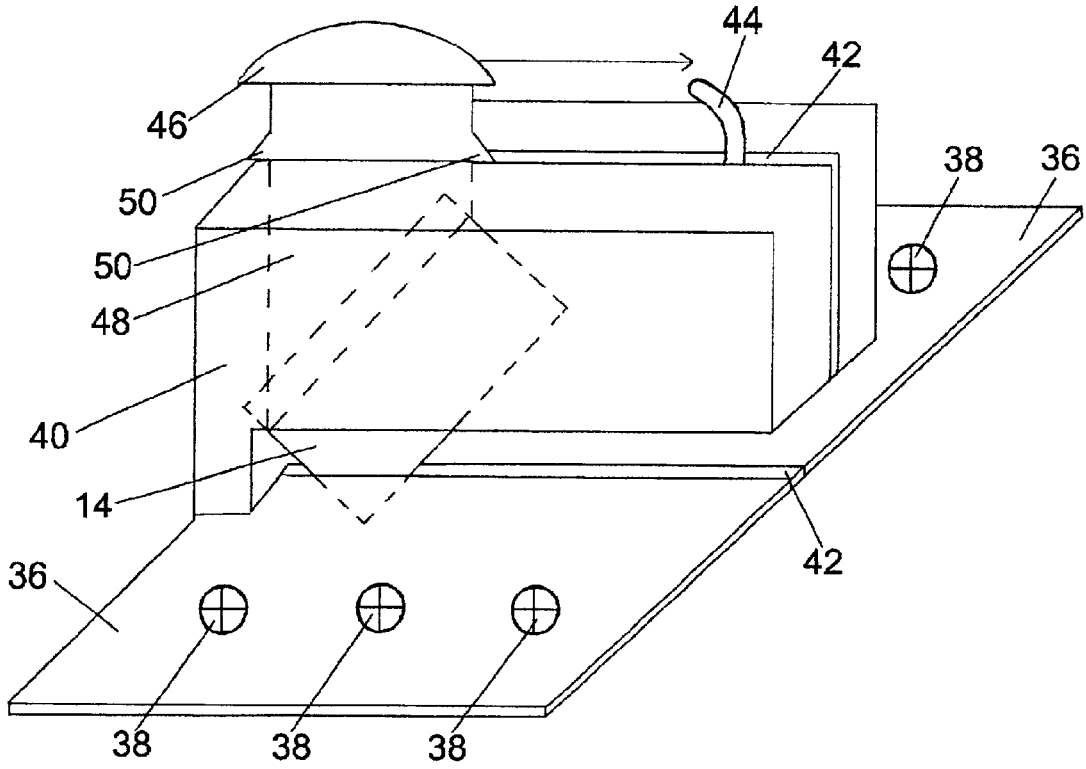
FIGS. 3A to 3C show aspects of a similar intravenous bag opener, with hook and dynamic blade portion
Figure 3B:
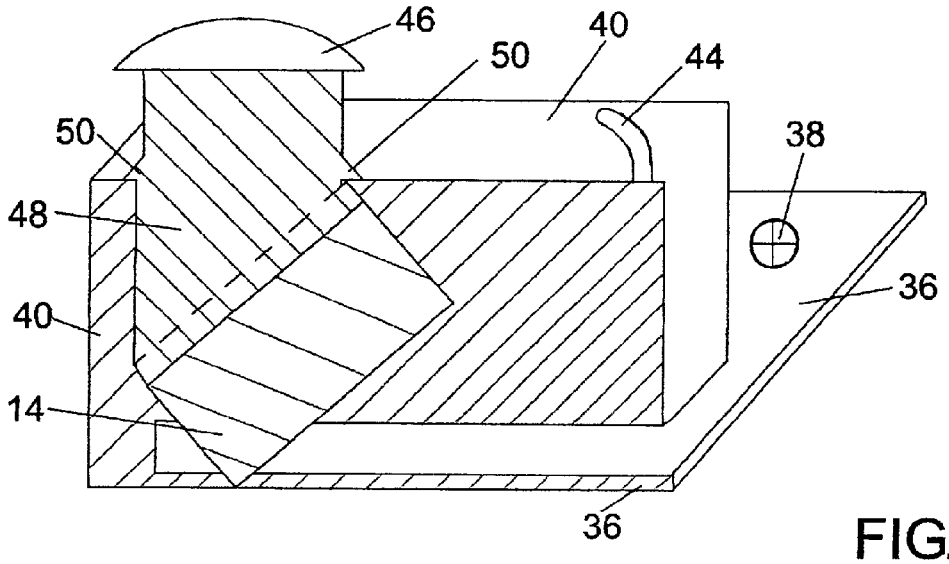
Figure 3C:
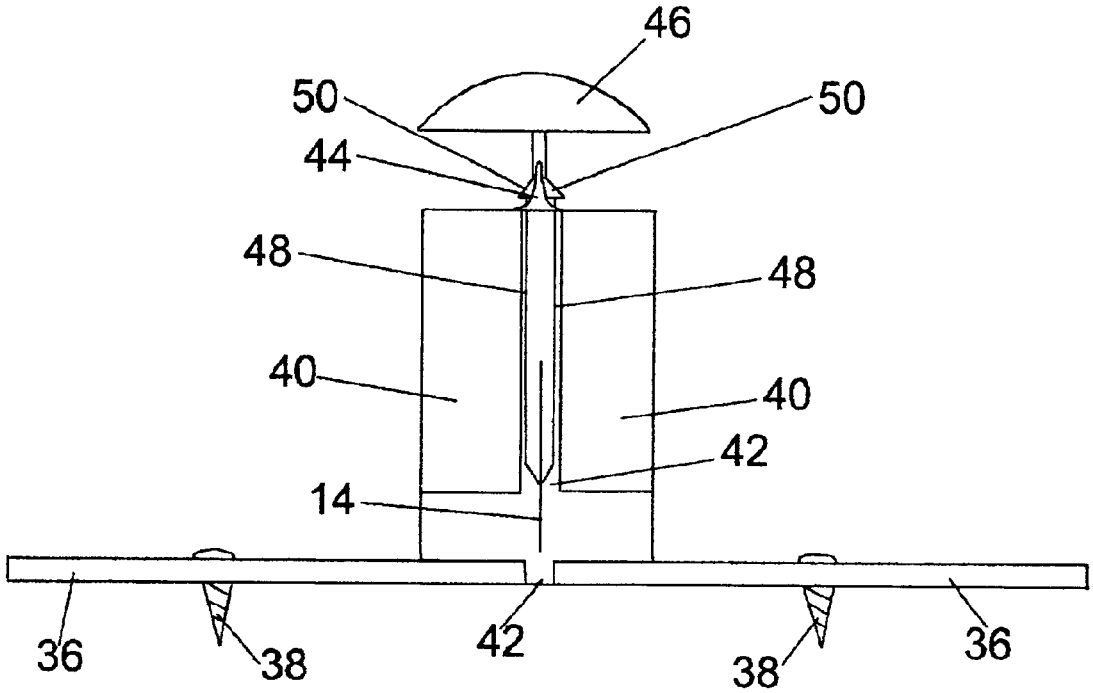

Description—FIGS. 3A–3C—Alternative Embodiment

FIGS. 3A–3C show an alternative embodiment. The opener shown in FIGS. 3A–3C is a dynamic opener, similar to the stationary opener illustrated in FIGS. 1A–1E with a few differences. FIG. 3A (side perspective), FIG. 3B (side cross-section), and FIG. 3C (front cross section view) show a body 40 attached to a base 36 that has more than one fastener 38. The body 40 of the dynamic opener sits on top of the base 36, but no delineation exists between the two. The razor 14 is held by a razor holder 48. The razor holder 48 is topped with an ergonomic handle 46. The razor 14 and holder 48, slide in a slot 42. A dual use safety block and hook 44 is on the superior side of the body, at the end of the slot 42. The slot 42 is the path of the razor, and it is marked on the front of the opener. There are protrusions 50 on the razor holder 48.

Operation—FIGS. 3A–3C—Alternative Embodiment

In order to use the dynamic opener, the razor holder 48 is removed from the body by pulling up on the ergonomic handle 46. The razor 14 is placed in the razor holder 48 by sliding the blunt end of the razor between the two pieces of metal that comprise the holder. The razor and holder can then be replaced in the body. The protrusions 50 on the razor holder 48 allows the razor holder to be inserted into the slot 42 and to remain at a constant height when the opener is used as razor is brought across the sealed plastic. The razor is prevented from extending beyond the body 40 by the dual purpose safety block and hook 44. The bag to be opened is placed in between the body and base and is to be lined up with the slot 42. The user then grasps the ergonomic handle 46, sliding it in the slot 42 along the length of the body 40, which in turn brings the razor across the plastic opening the bag.

Conclusion, Ramifications and Scope of Invention

Accordingly, the reader will see that the intravenous bag opener of this invention provides an easy way to open the outer packaging of intravenous bags. Opening the IV bags can be done quickly with this device, which is essential for use in many medical settings. The guidelines on the opener of this invention allows for accurate opening of any size bag. Having the opener mounted in an environment convenient to its users ensures availability in a chaotic environment, such as an emergency room, while a portable version would be a necessity in other medical environments, such as on a hospital floor where staff traveled from room to room. Most of all, the opener of this invention provides a safe and ergonomically correct device that would eliminate the repetitive motion injuries associated with the current method of opening the bags.

While the above description contains many specificities, these should not be construed as limiting the scope of the invention, but as merely providing illustrations of some of the presently preferred embodiments of this invention. For example, the body, or base can have other shapes, such as round, oval, square etc.; the base can be fastened to a surface by a fastener other than a screw or nail, such as glue or other fastening or binding substance or object; the base and body can be made as one unit or in modular parts; the hook can be located in various places such as the front, back, side, top etc.; the shape of the hook or hooks can vary in terms of the degree of curve; the safety blocks can be located directly in front of the razor, or on the edge of the body, etc.; the ergonomically designed handle can take on other ergonomically correct shapes; the razor could be held by a different holder; the means for replacing the razor could vary by having a button to push the razor out of the body, or by having a more mechanized opener that stores extra razors inside and replaces the used razor after a set number of uses etc.

Thus, the scope of the invention should be determined by the appended claims and their legal equivalents, rather than by the examples given.

I claim:

1. An intravenous bag packaging opener comprising:

a. a razor cutting element that has a sharp side and a dull side, whereby said sharp side is positioned to provide a means for cutting or opening plastic or other packaging material when said material is brought perpendicularly across said razor cutting element, and b. a body stabilizing and partially enclosing said razor cutting element so that said sharp side of said razor cutting element is partially exposed exteriorly of said body, and c. a hook element that is attached to or is a part of said body, whereby said hook provides a means for easily removing cap from intravenous bag, and d. a safety guard element that is attached to or a part of said body in front of said razor cutting element, and e. one or more guidelines on said body that represent position of said razor cutting element inside said body.

2. An intravenous bag packaging opener as recited in claim 1 wherein a. said dull side of said razor cutting element is partially exposed exteriorly to said body to allow easy removal and replacement of said razor cutting element, and b. a cover overlies said body, covering the exposed, dull side of said razor cutting element, and c. a base is attached to or a part of said body providing means for secure attachment of said body to a stable horizontal surface.

3. An intravenous bag packaging opener as recited in claim 1 wherein a. said body is comprised of two halves that are bound together by screws or other binding element to encase said razor cutting element, and b. said body has brackets to hold said razor cutting element securely inside said body, and c. said body is molded and designed to provide a portable intravenous bag packaging opener with an ergonomically correct grip.

4. An intravenous bag packaging opener as recited in claim 1 wherein:

a. a base is attached to or a part of said holder providing means for secure attachment of said body to a stable horizontal surface, and b. said body is comprised of two equal halves separated by a slot that is wide enough to house said razor cutting element, and c. a razor holder grasps said razor cutting element that is in said slot, and provides an ergonomically correct grip to allow said razor cutting element to be moved the length of said body providing a dynamic means for opening the intravenous bag packaging.

* * * * *